United States Patent [19]

Murphy

[11] Patent Number: 4,476,717

[45] Date of Patent: Oct. 16, 1984

[54] SCANNING GAUGE APPARATUS

[76] Inventor: Richard F. Murphy, 15 Bond St., Wilmington, Mass. 01887

[21] Appl. No.: 266,563

[22] Filed: May 22, 1981

[51] Int. Cl.[3] ..... B21B 39/14

[52] U.S. Cl. ..... 73/159

[58] Field of Search ..... 73/159; 250/563

[56] References Cited

U.S. PATENT DOCUMENTS 3,190,261 6/1965 Ziffer ..... 73/159

3,474,668 10/1969 Mangan ..... 73/159

3,670,568 6/1972 Kubo ..... 73/159

*Primary Examiner*—Charles E. Frankfort

*Assistant Examiner*—Denis E. Corr

[57] ABSTRACT

Apparatus is disclosed for controlling a pair of transverse scanning gauges disposed along the length of a moving sheet of material whereby continuous same-spot measurements of the material may be made irrespective of any variations in the speed of the material even as it traverses the distance between the scanning gauges.

2 Claims, 1 Drawing Figure

SCANNING GAUGE APPARATUS

This invention relates in general to scanning gauge apparatus and, more particularly, to apparatus for providing the same-spot measurement of material which passes between a pair of scanning gauges located along the length of a moving sheet of material.

BACKGROUND OF THE INVENTION

Many industrial processes involve a moving sheet of material to which a coating is applied, a liquid absorbed, a material laminated, or the physical characteristics of which are changed. It is often only possible to measure and thereby control this change in the material differentially; i.e., by measuring the moving sheet both before and after the change has occurred. In such a differential measuring scheme it is important to make both the before (Base) and after (Gross) measurements at the same spot unless the material is sufficiently uniform so that the measurement errors due to the lack of same-spot measurement are acceptably small.

For a moving sheet process, the velocity of the sheet is often itself a variable. Therefore, to maximize the amount of usable material formed, it is desirable to be able to immediately make same-spot measurements independent of sheet velocity or acceleration.

One method of measurement currently in use, long-term averaging, uses a differential measuring scheme with no attempt at same-spot measurement. To overcome the errors due to a lack of same-spot measurements the readings are averaged using various averaging techniques to achieve an acceptable measurement. In applications where the gross to base ratio is low, or where the base is non-uniform, the measurement results obtained with this technique are particularly poor.

A second method; i.e., same-spot differential measurement for a constant line speed, gives accurate results if the line speed remains constant, but errors are introduced whenever the line speed changes. To prevent such errors from becoming excessive during a line speed change, the traversal of the sensors is terminated and restarted at the new line speed. This action results in sections of the sheet not being measured during a line speed change.

A third method involves monitoring changes in line speed and line acceleration to set a new scanner traverse rate which then remains constant irrespective of any further line speed changes during the scan. Such discontinuous methods do not account for inacurracies that arise when the line speed changes during a scan interval, resulting in loss of measurement accuracy until the scanning rate is eventually updated.

OBJECTS OF THE INVENTION

It is therefore a primary object of the present invention to provide apparatus for controlling at least two scanning qauges disposed along the length of a moving sheet of material whereby continuous same-spot measurements of selected points disposed across the width of the sheet may be made and whereby variations in the speed of the moving material during a scan interval do not affect the same-spot measurement and therefore the accuracy of the measuring device.

SUMMARY OF THE INVENTION

The above objects and other desirable advantages are achieved by the apparatus of the invention in which a first and a second gauge are disposed along the length of a moving sheet of material whose characteristics are changed by apparatus, such as a coater, positioned intermediate the two gauges. Each gauge has a sensor which is made to traverse the width of the moving sheet at a rate proportional to the instantaneous line speed of the material traveling below the gauge.

Means are provided to delay the start of the scanning of the second gauge sensor until a specified amount of material has passed under the first gauge to assure that both gauge sensors intercept the same spot of material at the start of their respective scans.

Further means are provided to cause the first gauge sensor to remain at rest at the edge of the sheet of material until a specified amount of material has passed below the first gauge. This assures that, should the line speed increase subsequent to the passage of a spot of material beneath the first gauge, there will be sufficient time allotted for the second gauge sensor to complete its scan, reverse its direction, and ready itself for its next scanning operation.

BRIEF DESCRIPTION OF THE DRAWING

Other objects and advantages of the invention will become apparent upon reading the following detailed description and upon reference to the drawing, in which.

DETAILED DESCRIPTION OF THE INVENTION

Figure 1:
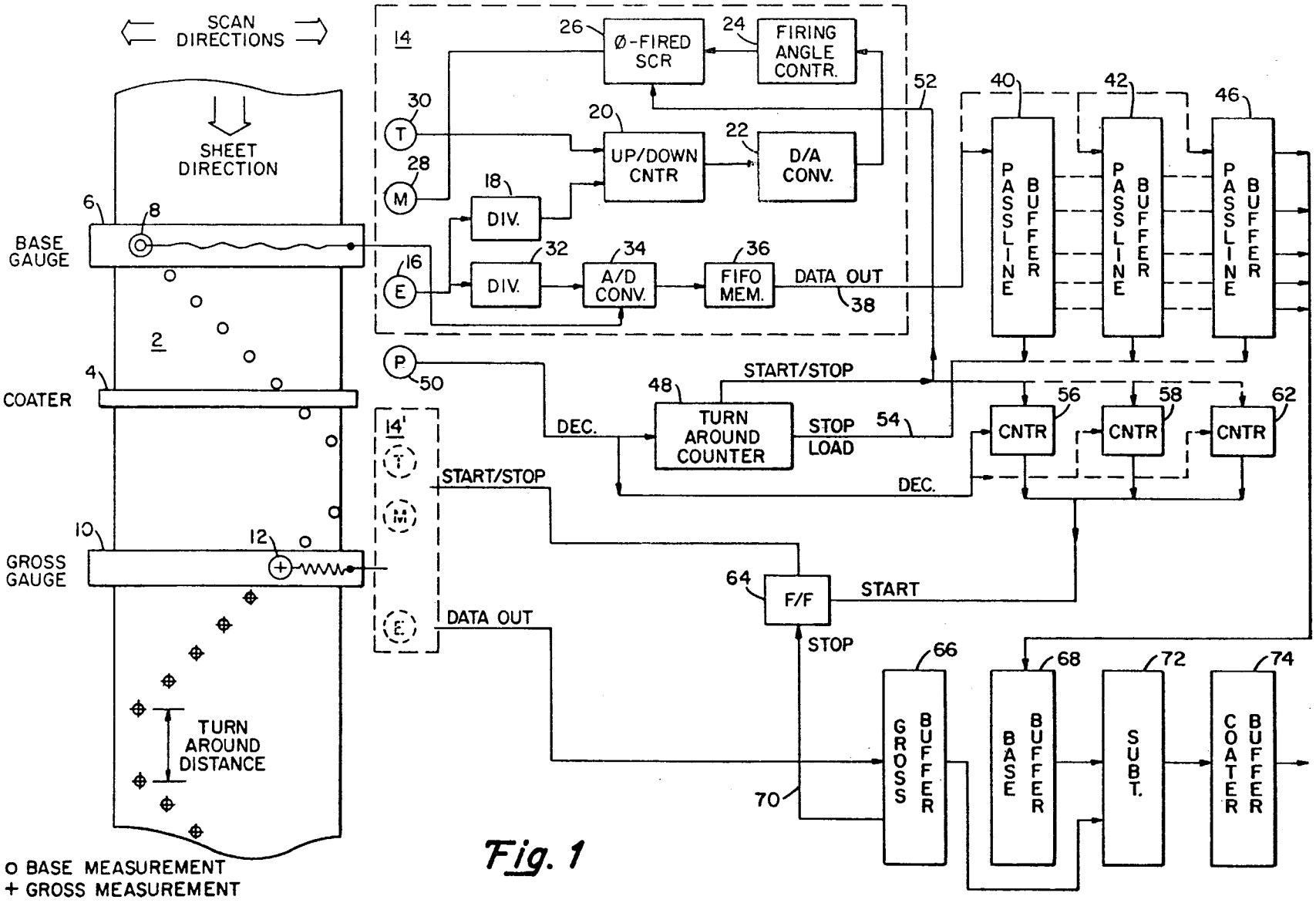
FIG. 1 is an illustration in diagrammatic form of an apparatus suitable for use in the practice of this invention.

While the invention will be described in connection with a preferred embodiment, it will be understood that we do not intend to limit the invention to this embodiment. On the contrary, we intend to cover all alternatives, modifications, and equivalents as may be included within the spirit and scope of the invention as defined by the appended claims.

Turning now to the drawing, there is shown a sheet of moving material 2 to which a coating is to be applied by a coater 4. A first transverse scanning gauge 6, hereinafter referred to as base gauge 6, is positioned upstream of coater 4. Base gauge 6 has associated therewith a sensor 8 adapted to measure the weight per unit area of select spots across the width of sheet 2. Similarly, a second gauge 10, hereinafter referred to as gross gauge 10, is positioned downstream of coater 4 and has a sensor 12 associated therewith, also adapted to measure the weight per unit area of select spots across the width of sheet 2.

Each of the gauges 6 and 10 have associated therewith scan position and data collection electronic circuits contained within the dotted areas 14 and 14', respectively, of the drawing. Inasmuch as the aforementioned circuits are identical in structure and in operation for both gauges, only the circuits associated with base gauge 6 are shown and described in detail.

The scan position circuitry includes encoder 16, divider 18, up/down counter 20, digital to analog converter 22, firing angle controller 24, phase-fired silicon-controlled rectifier 26, and variable speed motor 28, which form a standard control loop that causes the sensor to traverse at a rate proportional to the output of line speed tachometer 30. Tachometer 30 provides pulses which are directly proportional to the length of material passing through the gauge. Therefore, the traversing or scanning rate of sensor 8 is directly proportional to the passage of the material through the gauge.

Encoder 16 also provides signals to the aforementioned data control circuitry which includes divider 32, analog to digital converter 34, and first in-first out (FIFO) memory 36. Because the encoder pulses are proportional to the linear motion of the material through the gauge via the motor control loop, and the encoder pulses also control the data collection, the data collection frequency is proportional to the length of material passing through the gauge.

The output of FIFO memory 36 associated with base gauge 6 is coupled via data output line 38 to a plurality of passline buffer memories 40–46, respectively. Each of the passline buffers is adapted to store the data derived from one traversing or scan of sensor 8 across the width of the material. If the gauges 6 and 10 are separated by a distance such that several measurement scans of the sheet are made by sensor 8 in advance of the measured material reaching gauge 10, then a passline buffer is required to accommodate the data derived during each such scan.

Turn-around counter 48 is initially loaded with a first count coincident with the stopping of the sensor 8 at the edge of the sheet. The stopping of the sensor is effected by a stop signal coupled to turn-around counter 48 via line 54 when a passline buffer has been fully filled with data. The count loaded into turn-around counter 48 corresponds to the length of material which must pass before sensor 8 starts to scan the sheet. Length pulser 50 provides pulses proportional to the passage of length of material passing through the system. These pulses are coupled to turn-around counter 48 to decrement the counter as the material passes through the gauge. When counter 48 is decremented to zero, a start signal is coupled from turn-around counter 48 to the scan position circuitry 14 to cause the sensor 8 to start its scan across the sheet and data is stored in the next passline buffer 40–46.

As previously mentioned, the scan position and data collection circuitry 14' associated with gross gauge 10 function in the same manner as the scan position and data collection circuitry 14 described above. In a process without shrinkage or stress between the base and gross gauges the output of line speed tachometer 30 could be used to feed the scan position circuitry of both gauges.

The starting of the traversal of sensor 12 associated with gross gauge 10 is controlled by passline counters 56–62. These counters, which are similar in number to the passline buffers, are loaded with a count corresponding to the distance between the base and gross gauges. This count is loaded into the appropriate passline counter upon reception of the start signal from turn-around counter 48. Therefore, when a passline counter 56–62 is decremented to zero by pulses received from length pulser 50, the same spot on the sheet that was passing by sensor 8 when it started a scan will now be positioned beneath sensor 12. Sensor 12 starts a scan when a passline counter 56–62 is decremented to zero by flip-flop 64. Sensor 12 data is stored in gross buffer 66 as the sensor 12 scans and the corresponding reading is removed from the appropriate passline buffer 40–46 and put into base buffer 68. When the required number of gross data points are collected, flip-flop 64 receives a signal on line 70 from gross buffer 66 and stops the movement of sensor 12.

It will be noted that there is a one-to-one correspondence between passline buffers 40–46 and passline counters 56–62. A passline counter is only loaded when its corresponding passline buffer is to be filled with data. All passline counters, however, are continuously decremented by the length pulser 50.

It is necessary that the gross sensor 10 be prepared to start a scan at the instant when a passline counter is decremented to zero. Therefore, turn-around counter 48 is necessary to accommodate the physical constraints that make the turn-around time non-zero. If it were not for this counter, the base sensor 8 could traverse a slowly moving sheet, stop, reverse direction, and start traversing in the opposite direction. The sheet could then accelerate and be at a higher speed when the same spot passes the gross sensor 12. The gross sensor 12 would then be required to stop, reverse direction, and start a scan in the opposite direction in a time less than the time the base gauge sensor 8 took to reverse its direction. The ratio of the sheet velocity as the spot passes the base sensor 8 to the sheet velocity as the spot passes the gross sensor 12 times the base sensor turn-around time would be the required gross turn-around time. Turn-around counter 48 obviates this problem by being loaded with a count corresponding to the length of sheet that could pass the sensor during the turn-around time at the highest velocity line speed. Thus, the apparatus described above permits same-spot measurement independent of line speed changes and results in the sensor tracking as shown on material 2.

The coating measurement can be obtained by appropriate subtraction by algorithm 72 and the result coupled to the coat buffer 74 after the same-spot base and gross data are made available in buffers 68 and 66, respectively.

While the aforementioned invention has been described with relation to a specific embodiment, various modifications will be apparent to those skilled in the art without departing from its spirit and scope.

For example, the above-described coating apparatus could be used for applications other than coating applications, with traversing gauge sensors of various configurations, and the principles described herein could be extended to systems employing three or more scanning gauges.

The invention claimed is:

1. In an apparatus for providing the samespot measurement of moving material having, first and second transverse scanning gauges each having a sensor associated therewith disposed along the length of a moving sheet of material, means for causing said first and second second scanning gauge sensors to traverse across said moving sheet of material at a rate proportional to the instantaneous line speed of said moving material, and to reverse the direction of traversing at each edge of said material, means for delaying the initiation of the scan of said second gauge sensor until a first predetermined amount of material has passed under said first gauge, whereby the same spot of material is positioned under said first and second transverse gauges at the start of the scans of their respective sensors, the improvement comprising, means for delaying the initiation of each scan of said first gauge sensor until a second predetermined amount of material has passed below said first gauge, whereby a sufficient time is provided for said second scanning gauge sensor to complete its reversing operation in instances where the line speed of said moving sheet of material has increased after passage of said material under said first gauge, wherein said means for delaying the initiation of the scan of said first gauge sensor includes a means for measuring the amount of material passing below the first gauge at the conclusion of each first gauge scan in a given direction, and for initiating the first gauge scan in the reverse direction only after the amount of material passed below the first gauge equals the product of the time required for reversal of said first gauge scan direction times the maximum line speed said material can achieve.

2. Apparatus in accordance with claim 1 wherein said means for delaying further comprises, a pulser producing a series of pulses, the length of said series being proportional to the amount of material passing beneath said first gauge sensor, a counter and means operative at the completion of each scan of said first gauge sensor for loading a predetermined count into said counter, said predetermined count corresponding to the amount of material passing under said first gauge sensor at maximum line speed during the time period required for reversal of scan direction and, wherein the output of said pulser is coupled to said counter to decrement said counter from said predetermined count to zero, and means operative when said counter is in said zero state to initiate the next scan of said first gauge sensor.

* * * * *